United States Patent [19]

Koa

[11] Patent Number: 5,067,773

[45] Date of Patent: Nov. 26, 1991

[54] FOAM SEAT CUSHION WITH CLAMPED EDGES

[75] Inventor: Chi H. Koa, Jackson, Mich.

[73] Assignee: Michigan Seat Company, Jackson, Mich.

[21] Appl. No.: 577,039

[22] Filed: Sep. 4, 1990

[51] Int. Cl.[5] ..... A47C 7/02

[52] U.S. Cl. ..... 297/457; 297/218

[58] Field of Search ..... 297/218–229, 297/454–459, 452, 441; 160/378, 380–383, 401–404

[56] References Cited

U.S. PATENT DOCUMENTS

| | | | |
|---|---|---|---|
| 3,222,698 | 12/1965 | Levenson | 5/361 |
| 3,341,251 | 9/1967 | Costin | 297/457 |
| 3,423,775 | 1/1969 | Cockerill | 297/218 |
| 3,778,104 | 12/1973 | Kusters | 297/458 |
| 3,823,980 | 7/1974 | Harnick | 297/455 |
| 3,851,920 | 12/1974 | Harris et al. | 297/455 |
| 4,018,479 | 4/1977 | Ball | 297/455 |
| 4,544,205 | 10/1985 | Molnar | 297/455 |
| 4,558,904 | 12/1985 | Schultz | 160/402 |
| 4,566,735 | 1/1986 | Frobose | 297/452 |
| 4,573,740 | 3/1986 | Frobose | 297/452 |
| 4,792,189 | 12/1988 | Shoran | 297/452 |
| 4,836,609 | 6/1989 | Hill | 297/218 |
| 4,890,883 | 1/1990 | Boerema et al. | 297/218 |

*Primary Examiner*—Kenneth J. Dorner
*Assistant Examiner*—James M. Gardner
*Attorney, Agent, or Firm*—Beaman & Beaman

[57] ABSTRACT

A foam seat cushion and rigid pan assembly permitting high production assembly techniques. The cushion cover includes a flap which is tucked under a retainer. The retainer includes a plurality of lances which pierce the cover flap and enter holes formed in the pan to preliminarily position the tensioned cover flap prior to the installation of permanent fasteners connecting the retainer to the pan.

5 Claims, 2 Drawing Sheets

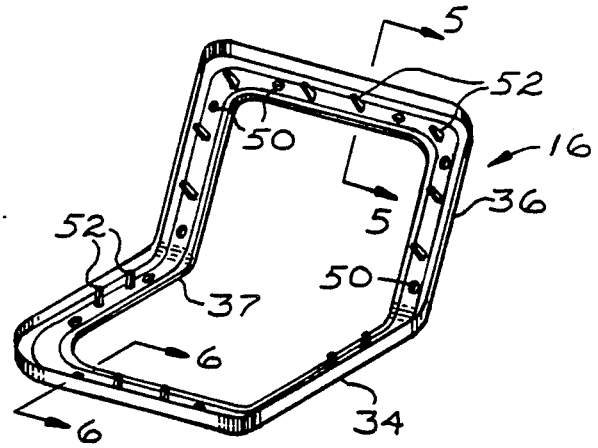
Fig 4
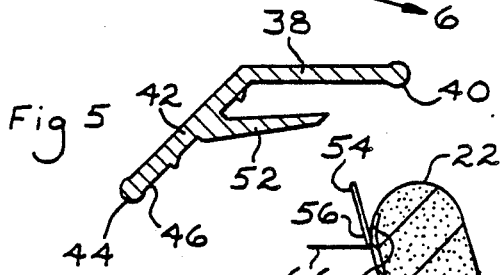
Fig 5
Fig 6
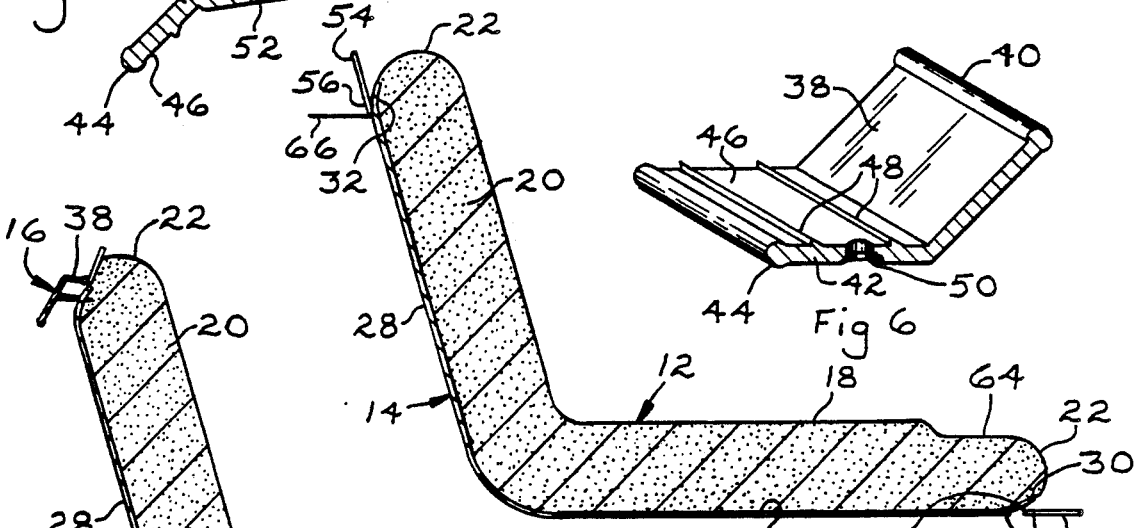
Fig 7
Fig 8
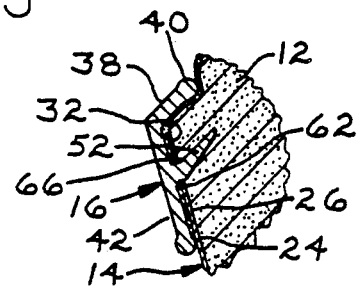
Fig 9
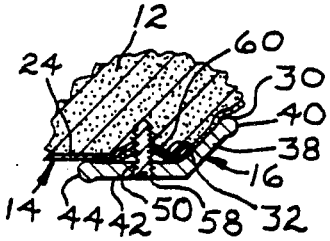
Fig 10
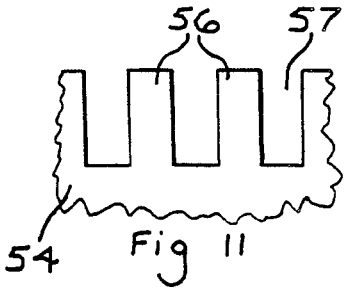
Fig 11

FOAM SEAT CUSHION WITH CLAMPED EDGES

BACKGROUND OF THE INVENTION

Foam seats commonly consist of a synthetic foam cushion having an upper surface having a vinyl flexible cover bonded thereto and the cushion is supported on its bottom and rear surfaces by a relatively rigid pan of sufficient strength to support the seat user's weight. Various arrangements have been used to attach the cushion to the pan and various retainers and decorative trim and crimp edge attachments are used with the pan to encase the pan peripheral edge and otherwise provide an attractive and practical transitional junction between the covered seat cushion periphery and the pan periphery.

The cushion cover may be tucked under seat components such as shown in U.S. Pat. No. 3,851,920, or may be tensioned to attach the pan to the cover such as shown in U.S. Pat. No. 3,778,104.

It is also known to tuck the peripheral region of the foam seat cover intermediate the bottom surface of the seat and the pan as shown in U.S. Pat. Nos. 3,222,698 and 4,566,735, but such constructions require relatively complicated assembly techniques not readily produceable under high production conditions.

In some foam seat constructions a separate retainer or edge member is mounted to the pan adjacent the pan periphery and the element is used to compress the edge of the cover against the pan to shield the cover terminating edge from view and provide an attractive and utilitarian transition between the seat pan structure and the foam cushion. Devices of this type are shown in U.S. Pat. Nos. 3,823,980 and 4,018,479. However, as permanent fasteners are employed to attach the retainers to the pan the preliminary positioning of the retainer to the pan and to the cover is difficult to maintain and successful assembly is difficult to uniformly achieve under high production.

Previously, a practical and low cost method of assembly of a foam cushion having a vinyl cover to a substantially rigid pan wherein the necessary aesthetic prerequisites are met has not been available, and it is a basic object of the invention to provide such a foam rubber seat assembly.

It is an object of the invention to provide a seat having a foam cushion and a flexible vinyl cover supported upon a substantially rigid pan wherein tension forces within the cover constitute the sole means for positioning the seat cushion on the pan.

Another object of the invention is to provide a foam seat assembly utilizing a foam cushion having a flexible vinyl cover wherein the cushion is held upon a substantially rigid pan by tension forces within the cover which has been attached to a peripheral region of the pan.

An additional object of the invention is to provide a process for assembling a foam cushion having a vinyl cover to a substantially rigid pan wherein the cover is tensioned to pull the cushion toward the pan and while the cover is under tension it is preliminarily affixed to the pan prior to permanent attachment thereto.

Yet a further object of the invention is to provide a method for assembling a foam seat cushion to a substantially rigid pan wherein the cushion includes a cover having a flexible flap, the flap being tucked between the peripheral region of the pan and a retainer while under tension, the retainer including preliminary staking devices for maintaining the desired tension and positioning of the cover prior to the retainer being permanently affixed to the pan.

Another object of the invention is to provide a foam seat assembly using a foam cushion wherein the vinyl cover of the cushion includes a flap and a terminating edge and wherein the cover flap passing over the cushion periphery is tucked against the peripheral region of a substantially rigid pan receiving the cushion and a retainer overlapping the cover flap preliminarily stakes and finally compresses the cover flap between the retainer and pan, and also shields the cover terminating edge from view.

In the practice of the invention a foam cushion having an upper surface and a periphery includes a flexible vinyl cover bonded to the cushion upper surface and the cover includes a loose flap adjacent the cover periphery.

The cushion is supported on a relatively rigid pan having a peripheral configuration substantially corresponding to that of the cushion and the cushion rests upon the pan for support thereon. The cover peripheral flap is tucked, while under tension, between the pan peripheral region and a retainer which is to be mounted to the pan adjacent the pan periphery.

Preliminarily, the cover flap is tensioned and positioned and the retainer is positioned in a preliminary manner relative to the pan. The retainer includes elongated lances which pierce the tensioned cover flap holding the cover under tension as the retainer is finally positioned upon the pan. Fasteners such as screws or the like are used to firmly affix the retainer on the pan whereby the cover flap is sandwiched between the retainer and the pan and the retainer includes a bulbous edge providing an attractive and smooth transition between the pan associated structure and the cushion cover.

The initial tensioning and tucking of the cover flap relative to the pan, and the initial staking of the cover flap to the pan and retainer permits the process of the operation to proceed under high production techniques and the method of assembly of a seat in accord with the invention is economical and provides a durable and attractive seat assembly.

BRIEF DESCRIPTION OF THE DRAWINGS

The aforementioned objects and advantages of the invention will be appreciated from the following description and accompanying drawings wherein:

FIG. 4 is a perspective view of the cover retainer, per se, FIG. 5 is an elevational sectional view of the retainer as taken along Section 5—5 of FIG. 4, FIG. 6 is an elevational sectional view of the retainer as taken along Section 6—6 of FIG. 4, FIG. 7 is an elevational side view of the foam seat and pan, and flap assembly fingers prior to tucking of the cover flap against the pan peripheral region, FIG. 8 is a view similar to FIG. 7 illustrating the position of the tucking fingers in the extended condition for tucking the cover flap intermediate the pan peripheral region and the retainer, FIG. 9 is an enlarged detail sectional view taken through the retainer lance and seat cushion when fully assembled, FIG. 10 is a detail elevational sectional view taken through the retainer and a screw fastener when fully assembled, and FIG. 11 is a detail plan view of the cover tucking fingers used to position the cover between the pan and retainer.

DESCRIPTION OF THE PREFERRED EMBODIMENT

Figure 1:
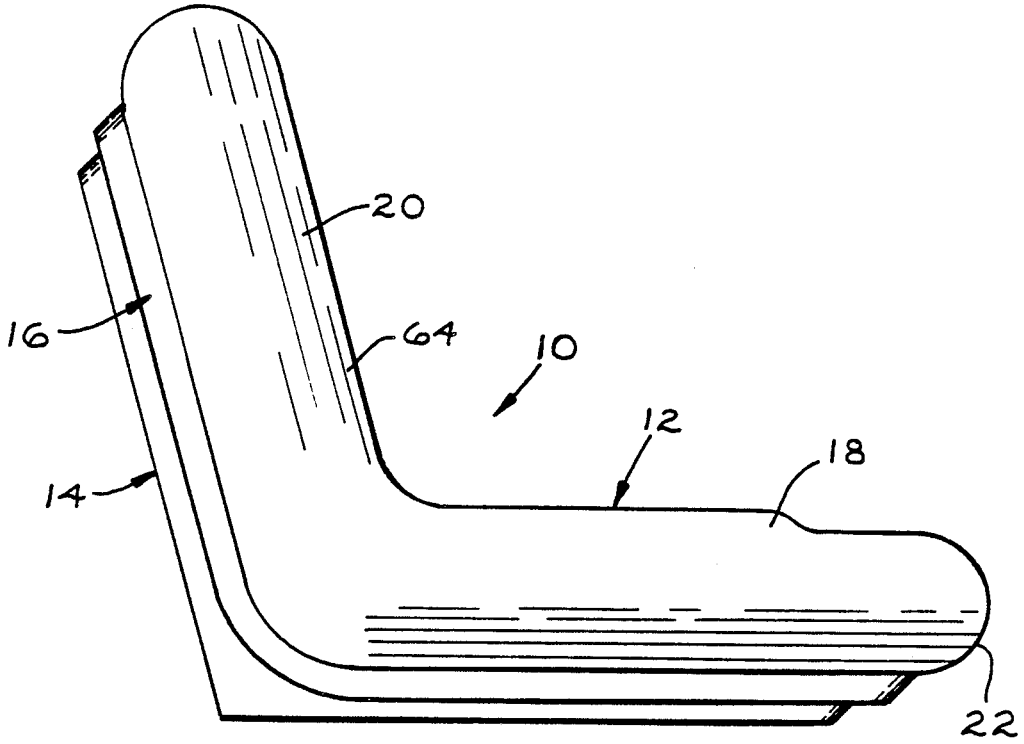
FIG. 1 is a side elevational view of a foam seat assembly in accord with the inventive concepts.
Figure 2:
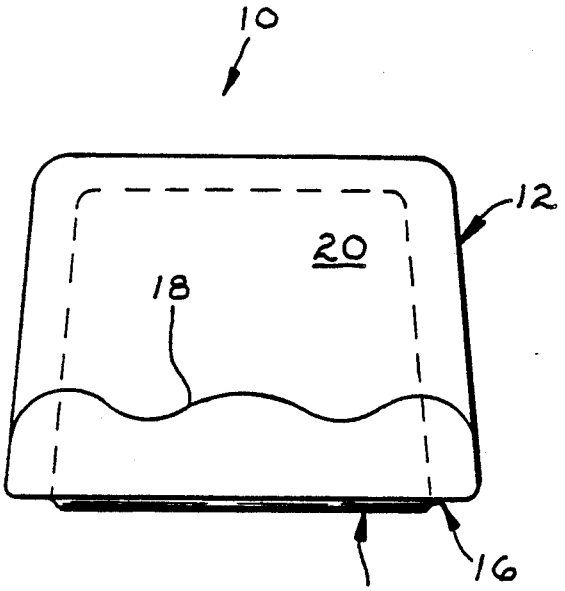
FIG. 2 is a front elevational view of the seat of FIG. 1 as taken from the right.
Figure 3:
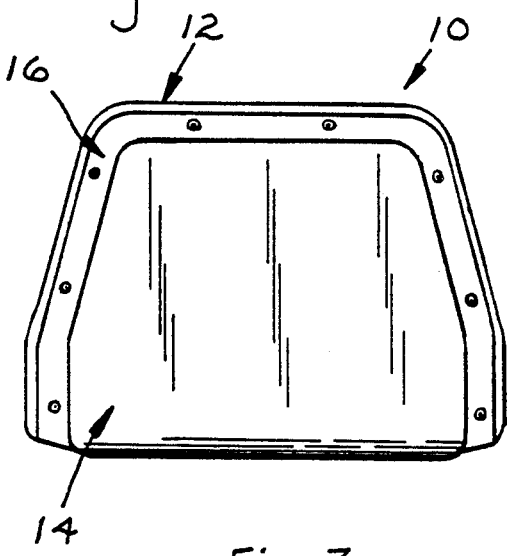
FIG. 3 is a rear elevational view as taken from the left of FIG. 1.

The basic arrangement of a seat in accord with the invention is best appreciated from FIGS. 1-3. The seat, generally indicated at 10, includes a cushion 12 which rests upon a substantially rigid pan 14 which is usually constructed of metal, but could be formed of a synthetic plastic material. The cushion retainer 16 attaches to the pan, as later described, and is associated with the cover of the cushion to firmly hold and secure the cushion upon the pan.

The cushion 12 is preferably formed of a synthetic plastic foam of the type commonly used with seats, and the cushion includes a bottom portion 18 and a back portion 20. The edges of the cushion are of a rounded convex configuration defining a cushion periphery 22. The cushion includes a bottom surface 24 which engages the pan inner surface 26 when the cushion and pan are assembled.

The pan also includes an outer surface 28, and the pan is defined at its outer edge by the periphery 30. A pan peripheral region 32 exists throughout the circumference of the pan adjacent the periphery 30. The peripheral region of the pan is provided with holes for receiving the fastening screws and retainer lances, as later described.

The retainer 16 is preferably formed of an attractive synthetic plastic molded material and includes a bottom portion 34 and a back portion 36. The overall general configuration of the retainer 16 is substantially similar to that of the cushion 12 and pan 14, and the center of the retainer 16 is open as indicated at 37.

The cross-sectional configuration of the retainer 16 is best appreciated from FIGS. 5 and 6, and the retainer configuration includes a generally flat lip portion 38 terminating in the bulbous end edge 40. The retainer also includes a compression portion 42 angularly disposed to the lip portion 38 and the generally flat compression portion 42 terminates in the bulbous end 44.

The compression portion 42 includes an inner surface 46 upon which a plurality of generally continuous spaced ribs 48 are defined. The ribs 48 have a sharp apex and the purpose of the ribs is to frictionally engage the cover flap formed on the cushion.

The retainer 16 includes a plurality of holes 50 for receiving the fastening screws, and a plurality of elongated sharpened lances 52 are integrally defined on the retainer portion 42 at spaced locations as will be best appreciated from FIGS. 4 and 5. The lances 52 are generally parallel in length to the retainer lip portion 38 and include a sharp end as will be appreciated from FIG. 5.

The flexible cover 64, usually formed of vinyl, is bonded to the cushion top surface during foaming and molding of the cushion, and the cover extends over the cushion periphery 22 and includes a flexible flap 66 having a terminating end 68, FIG. 7. The flap 68 is not bonded to the foam of the cushion, and is of sufficient length as to extend about the cushion periphery 22 for being superimposed over the pan peripheral region 32.

Assembly of the cushion 12, pan 14 and retainer 16 is as follows:

The cushion 12 is formed by the molding of the resilient foam defining the cushion wherein the vinyl cover 64 is intimately attached to the cushion upper surface and much of the cushion periphery 22. The bottom side of the cushion is located upon the pan inner surface 26, and as the configuration of the pan inner surface substantially conforms to the bottom configuration of the cushion a close fit is achieved.

The oriented cushion 12 and pan 14 are placed within apparatus having slides defined thereon, not shown, whereby the finger bodies 54 may be located adjacent the pan peripheral region as shown in FIG. 7. The finger bodies 54, which constitute a plurality of substantially identical components arranged completely about the pan periphery are in substantial alignment with the pan peripheral region 32 adjacent the pan periphery 30 and the finger bodies 54 include a plurality of parallel fingers 56, FIG. 11, defining spaces 57 therebetween. The finger bodies 54 are inserted "inwardly" whereby the ends of the fingers 56 will engage the cover flap 66 and fold or tuck the cover flap 66 against the pan peripheral region 32.

While the fingers 56 are holding the cover flap 66 against the pan the cover flap will be tensioned pulling the cushion cover 64 tightly over the periphery 22 and firmly drawing the cushion into engagement with the pan 14 establishing a firm mechanical connection between the cushion and pan.

With the fingers 56 remaining "inwardly", the retainer 16 is placed upon the pan peripheral region as shown in FIG. 8. As the pan peripheral region 32 includes lance holes 62 located to receive the retainer lances 52 movement of the retainer 16 into place against the pan peripheral region 32 causes the lances 52 to pierce the cover flap 66 and enter the holes 62. Due to this lancing of the cover flap the cover is maintained in a preliminary attached state, under tension, and the lances will firmly hold the cover flap in place against the pan peripheral region while maintaining the desired tension within the cover flap.

Upon the retainer 16 being firmly pressed against the pan peripheral region such that the retainer compression portion 42 engages the cover flap screws 58 may be inserted within hole 60 defined in the pan peripheral region for firmly attaching the retainer 16 upon the pan 14 as will be appreciated from FIG. 10. Tightening of the screws 58 firmly compresses the cover flap 66 between the pan peripheral region 32 and the retainer 16 whereby the ribs 48 will frictionally engage the cover flap, and as the lances 52 also pierce the cover flap a firm interconnection between the retainer and pan and cover flap is achieved which firmly maintains the cushion 12 upon the pan 14.

As will be readily appreciated from FIGS. 9 and 10, the presence of the bulbous end 40 on the retainer produces an attractive and snag-free transition between the retainer and the cover flap firmly holding the cover flap and cover under tension as initially produced by the fingers 56.

Of course, it will be understood that the finger spaces 57 are in alignment with the lance holes 62 so that fingers 56 do not interfere with the penetration of the lances 52 through the cover flap.

The width dimension of the retainer portion 42 is sufficient to overlap the cushion flap end 68 so that the cover flap end 68 is not visible, and upon complete assembly an attractive relationship between the pan 14 and retainer 16 is achieved as will be appreciated from the rear view of FIG. 3.

After initial assembly of the retainer 16 on the pan peripheral region 32 wherein the lances 52 have entered the pan holes 62 and have penetrated the cover flap the fingers 56 can be withdrawn so as not to interfere with the insertion of the screws 58 and the final tightening and positioning of the retainer 16 on the pan peripheral region.

From the above description it will be understood that the use of the retainer 16 to initially lance and "tack" the cover flap to the pan permits the process of seat assembly to be accomplished under high production techniques and an attractive seat assembly is achieved by the use of the retainer 16.

It is appreciated that various modifications to the inventive concepts may be apparent to those skilled in the art without departing from the spirit and scope of the invention.

I claim:

1. A seat comprising, in combination, a synthetic foam cushion having top and bottom surfaces and a peripheral edge, a flexible cover attached to said cushion top surface and extending over said cushion peripheral edge and having a flexible peripheral flap extending beyond said cushion peripheral edge, said flap having a terminating edge, a substantially rigid pan having a configuration substantially similar to that of said cushion bottom surface and having a periphery and a peripheral region, spaced openings defined in said pan peripheral region inwardly of said pan periphery, a substantially closed periphery centrally open retainer separate from said pan and having a configuration similar to that of said pan peripheral region, a plurality of spaced elongated lances defined on said retainer corresponding in spacing to said pan peripheral region openings, and fastening means attaching said retainer to said pan peripheral region with said lances extending through said pan openings, said flap including a portion extending over said pan periphery and engaging said pan peripheral region, said retainer being superimposed over said flap portion whereby said flap portion is sandwiched between said retainer and said pan peripheral region and said lances penetrate said flap portion to maintain said flap portion in position prior to installation of said fastening means, said flap terminating edge being located between said retainer and said pan peripheral region wherein said retainer shields said flap terminating edge from view.

2. In a seat as in claim 1, said cover flap portion being under tension and maintaining said cushion bottom surface in engagement with said pan.

3. In a seat as in claim 1, friction producing means defined on said retainer engaging said cover flap portion.

4. In a seat as in claim 3, said friction producing means comprising at least one elongated rib defined on said retainer.

5. In a seat as in claim 1, said retainer being formed of a synthetic plastic material.

* * * * *